US011289856B1

(12) United States Patent
Teng et al.

(10) Patent No.: US 11,289,856 B1
(45) Date of Patent: Mar. 29, 2022

(54) ELECTRICAL CONNECTOR GROUNDING STRUCTURE

(71) Applicant: ACES ELECTRONICS CO., LTD., Taoyuan (TW)

(72) Inventors: Chang-Ho Teng, Taoyuan (TW); Rong-Hsun Kuo, Taoyuan (TW); Chia-Sheng Liang, Taoyuan (TW)

(73) Assignee: ACES ELECTRONICS CO., LTD., Taoyuan (TW)

( * ) Notice: Subject to any disclaimer, the term of this patent is extended or adjusted under 35 U.S.C. 154(b) by 0 days.

(21) Appl. No.: 17/019,837

(22) Filed: Sep. 14, 2020

(51) Int. Cl.
*H01R 13/6597* (2011.01)
*H01R 13/6581* (2011.01)
*H01R 13/6594* (2011.01)

(52) U.S. Cl.
CPC ..... *H01R 13/6597* (2013.01); *H01R 13/6581* (2013.01); *H01R 13/6594* (2013.01)

(58) Field of Classification Search
CPC ..... H01R 13/6597; H01R 13/6581; H01R 13/6594
USPC ..... 439/607.28
See application file for complete search history.

(56) References Cited

U.S. PATENT DOCUMENTS 5,749,741 A * 5/1998 Bellas ..... G06K 7/0047 361/718
6,702,616 B1 * 3/2004 Chang ..... H01R 13/6273 439/607.23
7,410,370 B2 * 8/2008 Sprouse ..... H01R 13/6485 439/95
7,748,999 B1 * 7/2010 Sun ..... H01R 13/506 439/79
7,833,065 B2 * 11/2010 Lin ..... H01R 27/00 439/639
8,262,411 B2 * 9/2012 Kondo ..... H01R 13/6471 439/607.01
9,312,641 B2 * 4/2016 Wang ..... H01R 13/6585
9,356,404 B2 * 5/2016 Yu ..... H01R 13/6594
9,391,410 B2 * 7/2016 Yu ..... H01R 13/6594
9,653,851 B1 * 5/2017 Yuan ..... H01R 24/60
9,673,569 B2 * 6/2017 Zhang ..... H01R 13/6585
10,116,100 B2 * 10/2018 Feng ..... H01R 13/6596
(Continued)

*Primary Examiner* — Peter G Leigh
(74) *Attorney, Agent, or Firm* — Muncy, Geissler, Olds & Lowe, P.C.

(57) ABSTRACT

Electrical connector grounding structure includes electrically insulative housing having accommodation hole located on base thereof and tongue plate forwardly extended from base, conducting terminal sets positioned in electrically insulative housing and including one or more than one grounding terminal, one or more than one power terminal and plurality of signal terminals, conducting member mounted in accommodation hole and having first contact portion located at top and second contact portion downwardly extended from first contact portion and kept in contact with grounding terminal, and shielding shell surrounding electrically insulative housing and kept in contact with first contact portion. Grounding terminal, conducting member and shielding shell form common ground loop to guide electromagnetic interferences and noises generated around electrical connector to circuit board for grounding release, making overall signal transmission quality more stable and reliable and achieving the effect of improving overall signal transmission stability.

8 Claims, 14 Drawing Sheets

(56) References Cited

U.S. PATENT DOCUMENTS

| | | | | |
|---|---|---|---|---|
| 10,164,378 | B2 * | 12/2018 | Shah | H01R 24/64 |
| 10,218,126 | B2 * | 2/2019 | Kurosawa | H01R 24/60 |
| 10,218,134 | B2 * | 2/2019 | Tsai | H01R 13/6585 |
| 2010/0254662 | A1 * | 10/2010 | He | H01R 13/6471 385/75 |
| 2015/0340791 | A1 * | 11/2015 | Kao | H01R 13/42 439/676 |
| 2017/0070013 | A1 * | 3/2017 | Hsu | H01R 13/6585 |

* cited by examiner

ELECTRICAL CONNECTOR GROUNDING STRUCTURE

BACKGROUND OF THE INVENTION

1. Field of the Invention

The present invention relates to electrical connector technology, and more particularly to an electrical connector grounding structure, which uses at least one grounding terminal of a conducting terminal sets, a conducting member and a shielding shell form a common ground loop to guide electromagnetic interferences (EMI) and noises generated around the electrical connector to the circuit board for grounding release, thereby making the overall signal transmission quality more stable and reliable and achieving the effect of improving the overall signal transmission stability.

2. Description of the Related Art

As life enters the era of technology, there will be many appliances, or products around the living environment, which are affected by technology, and they are all toward the use of technology-based electronics. In the use of technological products, the operation and control methods of input signals are usually used to start, close or control and set electronic and electrical products. Various home appliances, such as TVs, stereos, video recorders, digital channel receivers (MOD), multimedia playback devices, air conditioners, smart refrigerators, etc., or computer hosts, mobile phones, laptops and other electronic and electrical products, in addition to the original usage mode and function, they can also be connected to external peripheral equipment through connectors, such as: universal serial bus (USB), SATA type connector, eSATA type connector, RJ type connector, Mini USB connector, etc. to expand the practical functions of electronic and electrical products. For example, a TV can be externally connected with a video recorder, a digital channel receiver, a loudspeaker, a stereo, a computer host, or a digital camera, etc., for the transmission or storage of electronic signals. Or a keyboard, a mouse, a printer, a TV signal receiver and/or a modem, etc., can be connected to a computer host to expand the use of various electronic and electrical products. Therefore, electronic and electrical products are also equipped with many connectors and signal receivers, which can read or store and transmit signals to control the use of electronic and electrical products.

Among them, the universal serial bus (USB), because of its hot-swappable function, is the most widely used. In addition, since the transmission speed of electronic signals has been continuously improved, a high-speed transmission interface must be used to meet the transmission speed of a large number of electronic signals. The interface of electronic signal transmission has also been continuously improved, innovated to increase the speed of high-speed transmission of electronic signals. Therefore, the size of the interface for transmitting electronic signals has been enlarged, but it has also taken up space and affected the circuit layout. The size of interfaces used to transmit electronic signals between various electronic and electrical products has also been greatly reduced with the development of computers or notebooks. As the transmission speed of the high-speed transmission interface has improved significantly, the number of conductive metal conductors has also increased and the distribution is dense.

Nowadays, since the conductive metal conductors of the general-purpose serial bus interface are quite close in space, it is very easy to cause signal interference during high-frequency signal transmission due to the close proximity between adjacent conductive metal conductors during signal transmission (such as: electromagnetic wave interference, crosstalk interference, etc.), thereby reducing the stability of signal transmission. Furthermore, the circuit impedance (Z) of the high-speed transmission interface and the system motherboard interface must match. Only when these conditions are met can the interference be effectively reduced, so that the signal transmission between the high-speed transmission interface and the system motherboard interface can be carried out correctly, otherwise, the signal transmission between the high-speed transmission interface and the system motherboard interface will produce signal reflections and cause loss, deformation and distortion of electronic signals, resulting in bandwidth and electronic signal quality that do not meet the standards, and affecting the normal operation of the electronic devices (such as: desktop computers, laptops or tablets, etc.).

Therefore, how to try to solve the above-mentioned deficiencies and inconveniences of prior art designs is the direction that relevant industries urgently want to study and improve.

SUMMARY OF THE INVENTION

The present invention has been accomplished under the circumstances in view. It is therefore the main object of the present invention to provide an electrical connector grounding structure, which comprises an electrically insulative housing, a conducting terminal sets, a conducting member and a shielding shell. The electrically insulative housing comprises a base, an accommodation hole located on the base, and a tongue plate extended from a front side of the base. The conducting terminal set comprises at least one grounding terminal, at least one power terminal and a plurality of signal terminals respectively positioned in the electrically insulative housing. The conducting member is positioned in the accommodation hole of the electrically insulative housing, comprising a first contact portion and a second contact portion extended from a bottom side of the first contact portion and disposed in contact with the at least one grounding terminal. The shielding shell comprises a docking space that accommodates the electrically insulative housing to keep the shielding shell in electrical contact with the first contact portion of the conducting member. Since the at least one grounding terminal of the conducting terminal sets, the conducting member and the shielding shell form a common ground loop to guide electromagnetic interferences (EMI) and noises generated around the electrical connector to the circuit board for grounding release, the electrical connector grounding structure can effectively suppress or filter electromagnetic interferences (EMI) and crosstalk interferences generated during signal transmission, thereby making the overall signal transmission quality more stable and reliable and achieving the effect of improving the overall signal transmission stability.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
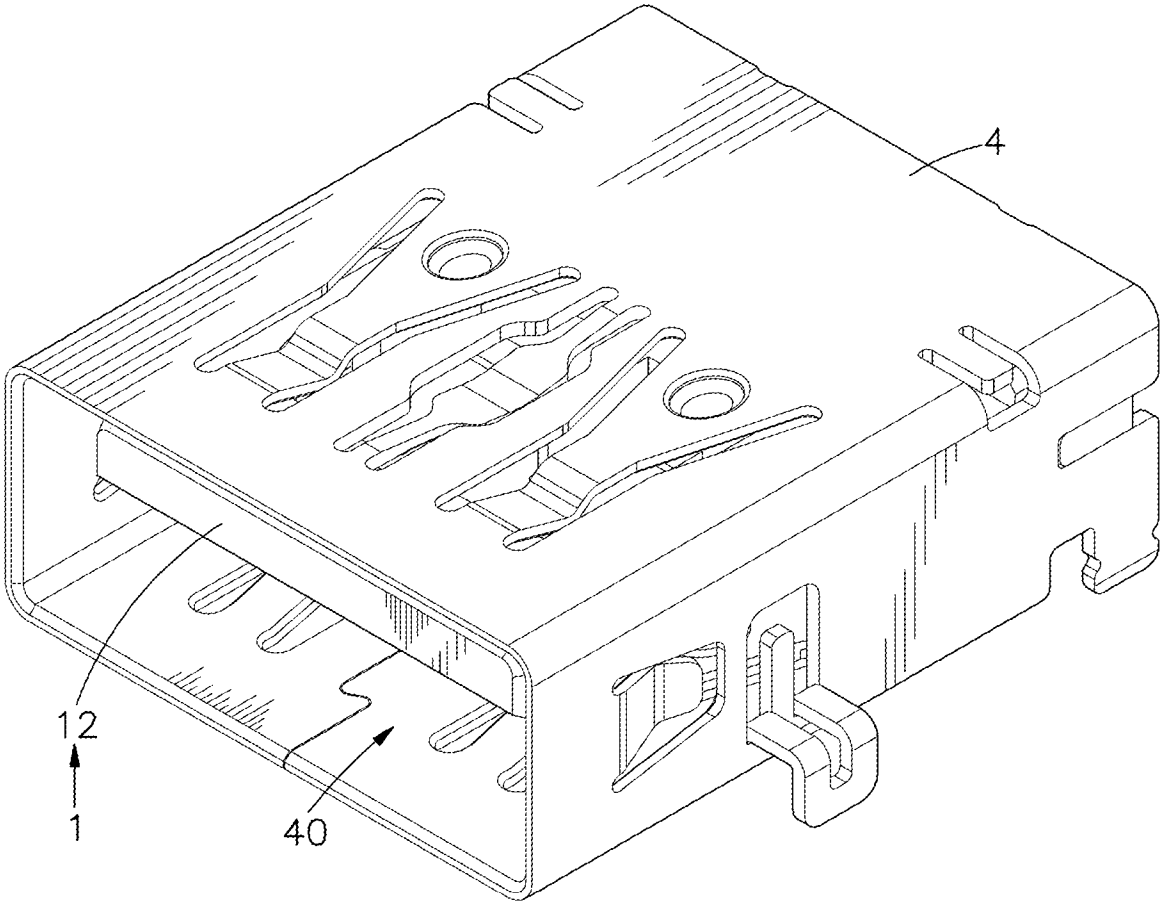
FIG. 1 is an oblique top elevational view of an electrical connector grounding structure in accordance with a first embodiment of the present invention.
Figure 2:
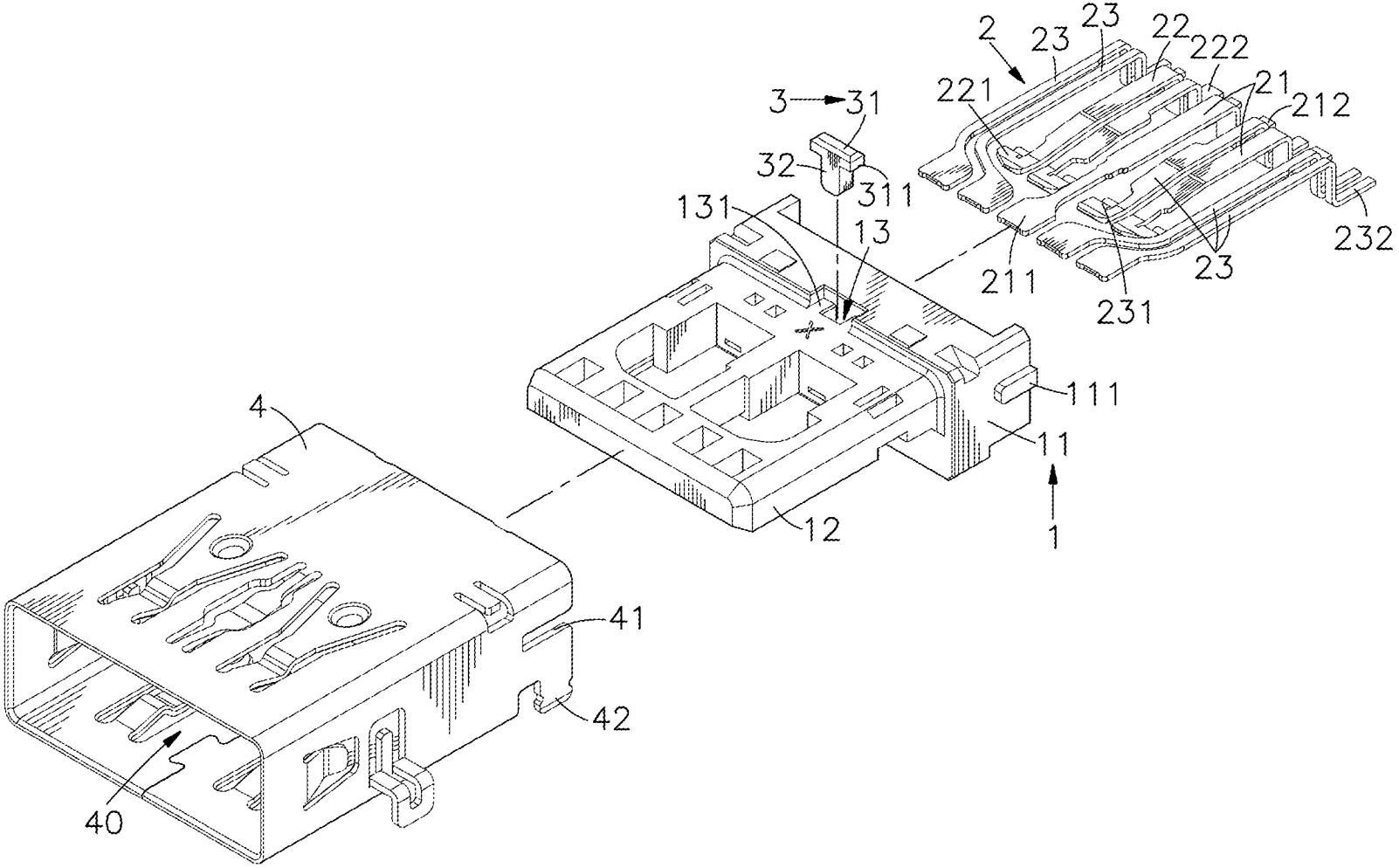
FIG. 2 is an exploded view of the electrical connector grounding structure of the first embodiment of the present invention.
Figure 3:
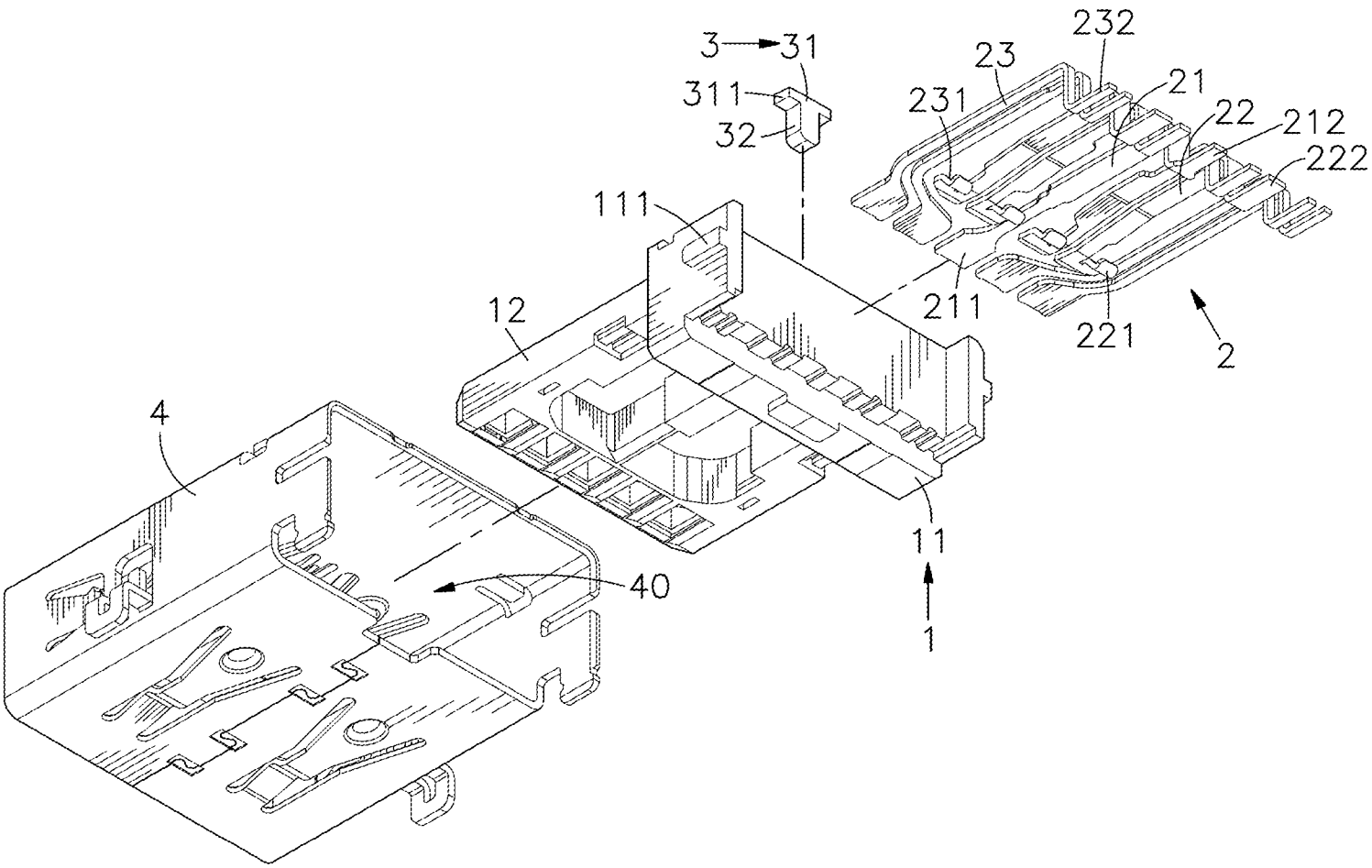
FIG. 3 is another exploded view of the electrical connector grounding structure of the first embodiment of the present invention when viewed from another angle.
Figure 4:
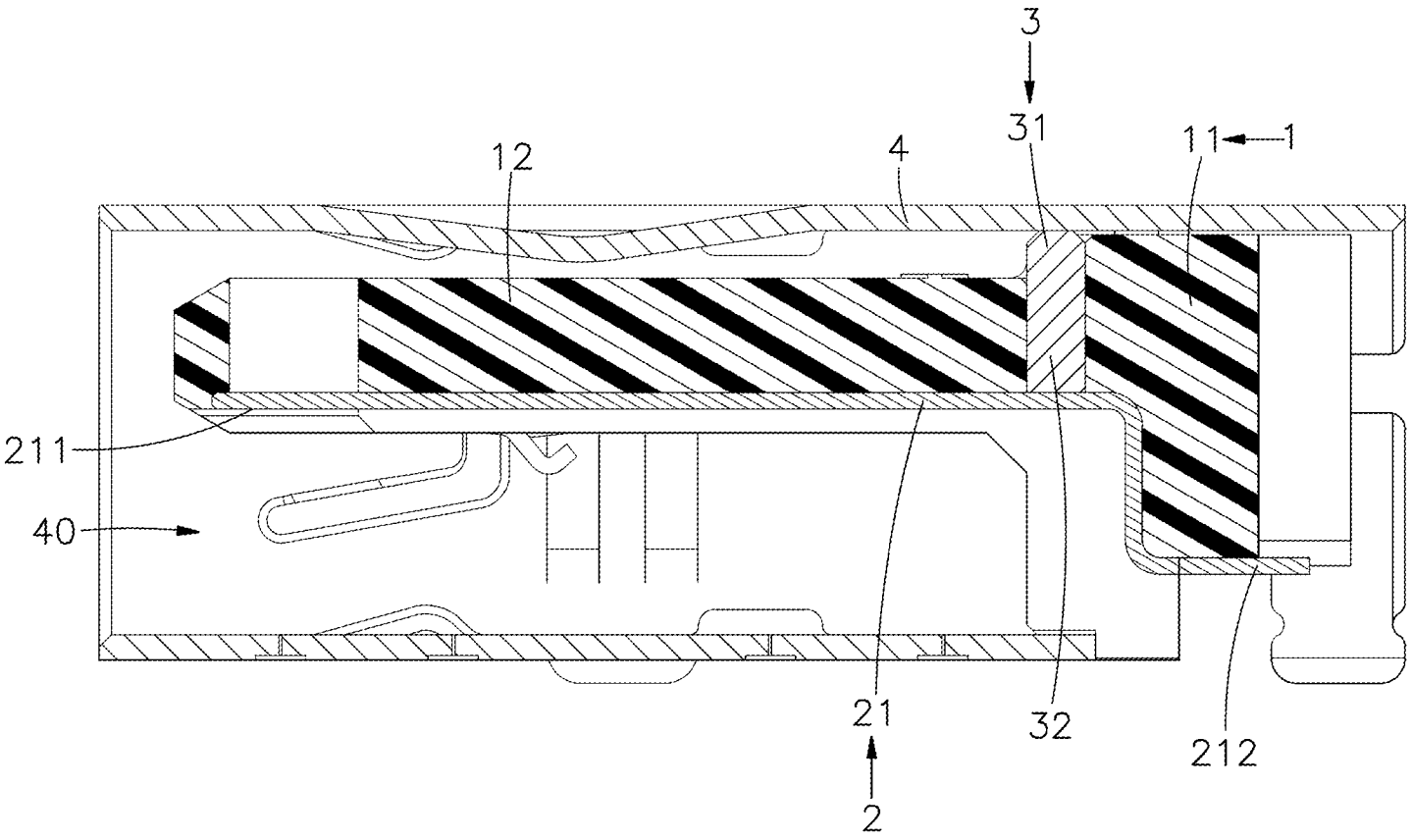
FIG. 4 is a sectional side view of the electrical connector grounding structure of the first embodiment of the present invention.
Figure 5:
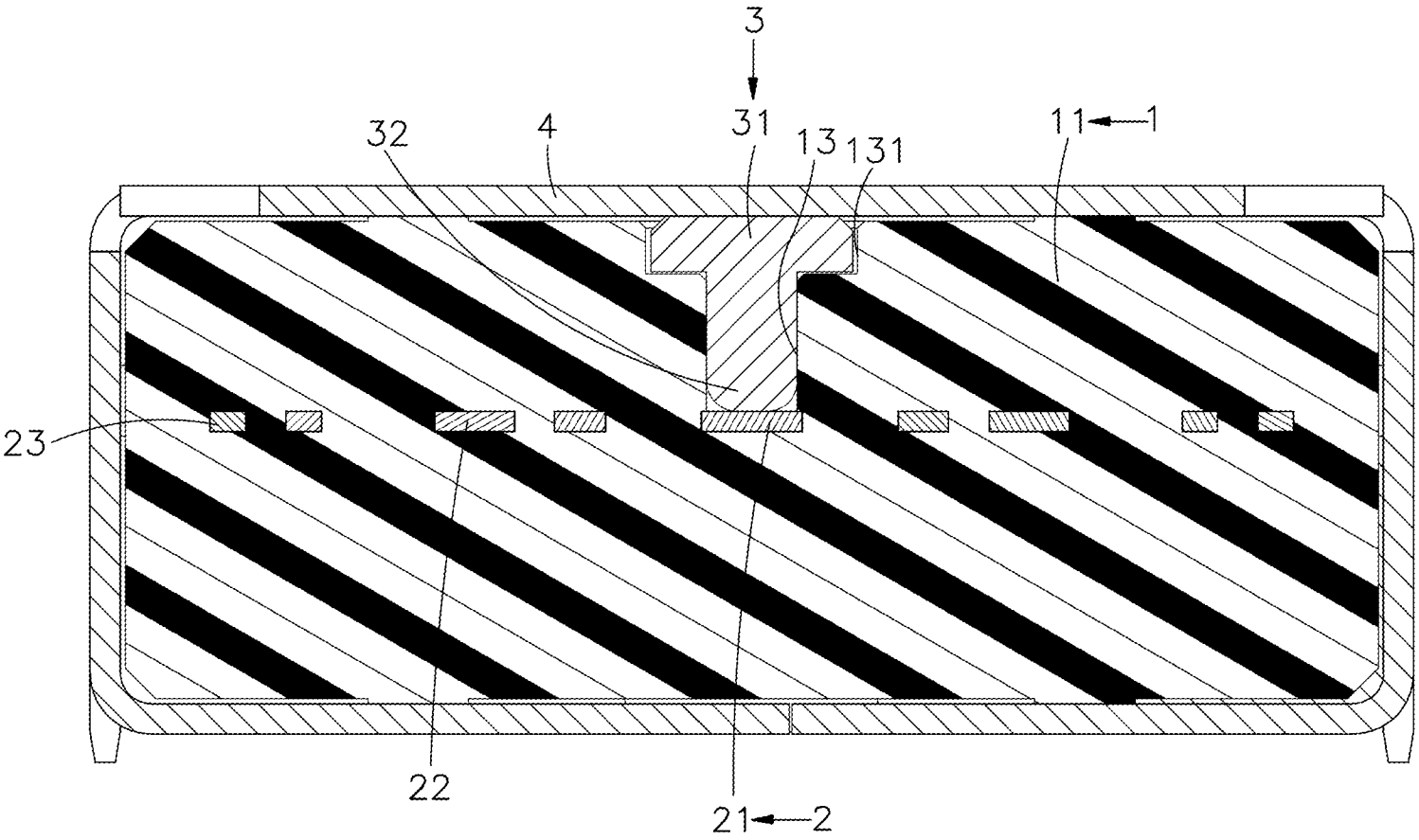
FIG. 5 is another sectional side view of the electrical connector grounding structure of the first embodiment of the present invention.
Figure 6:
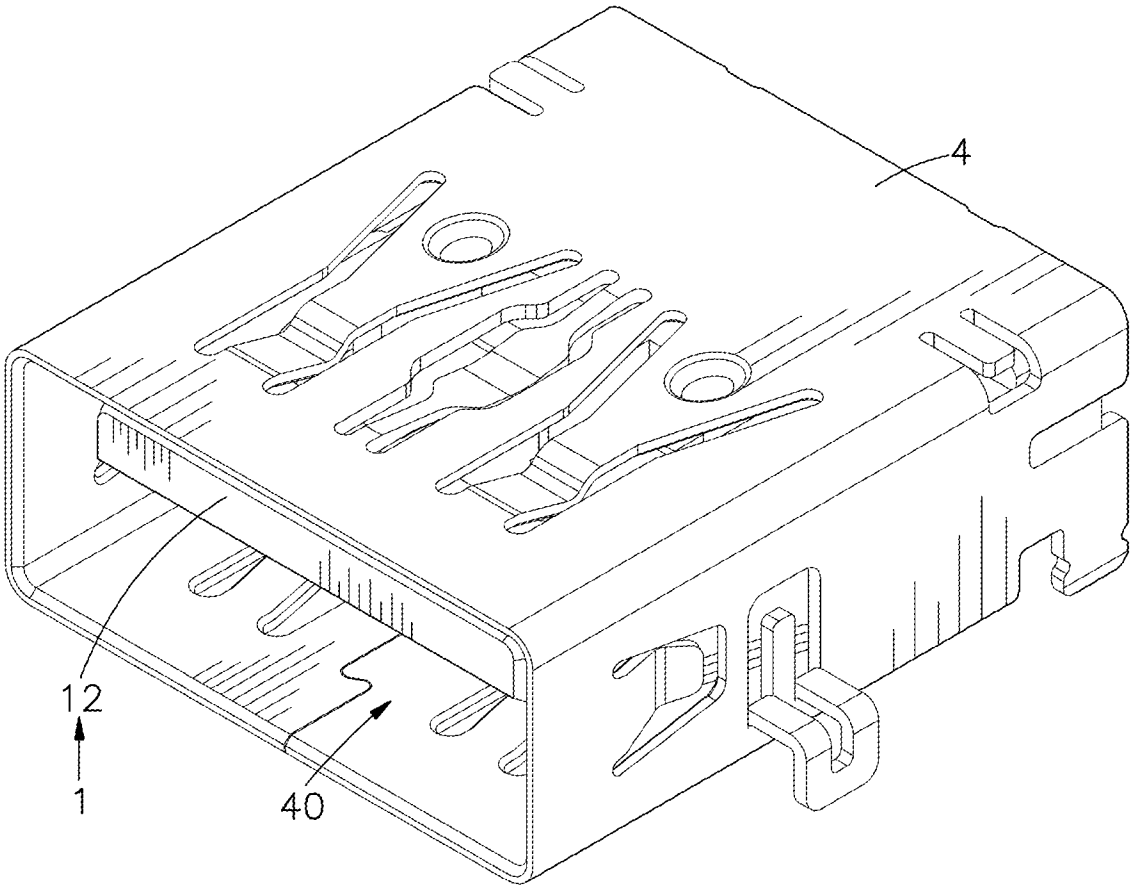
FIG. 6 is an oblique top elevational view of an electrical connector grounding structure in accordance with a second embodiment of the present invention.
Figure 7:
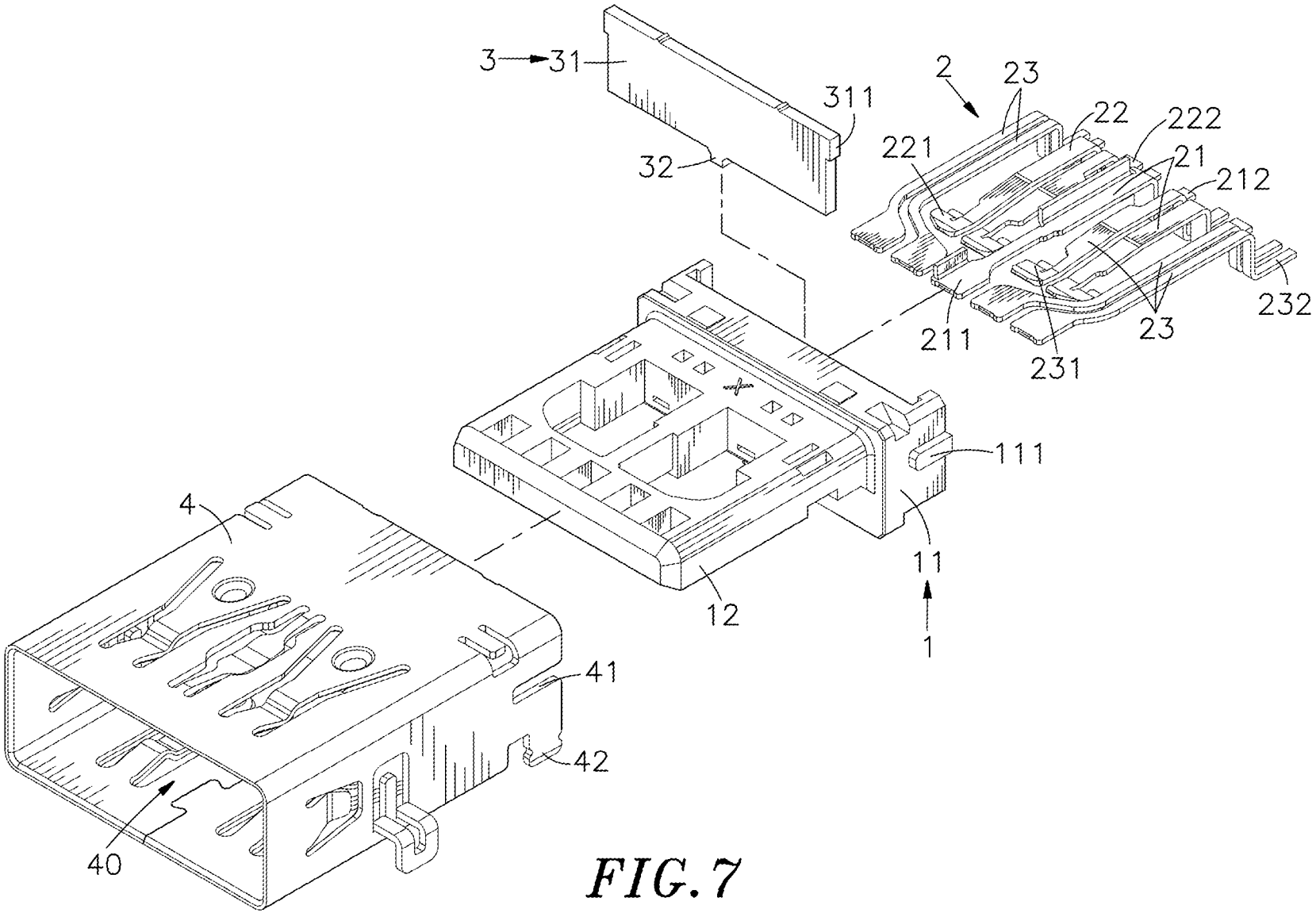
FIG. 7 is an exploded view of the electrical connector grounding structure of the second embodiment of the present invention.
Figure 8:
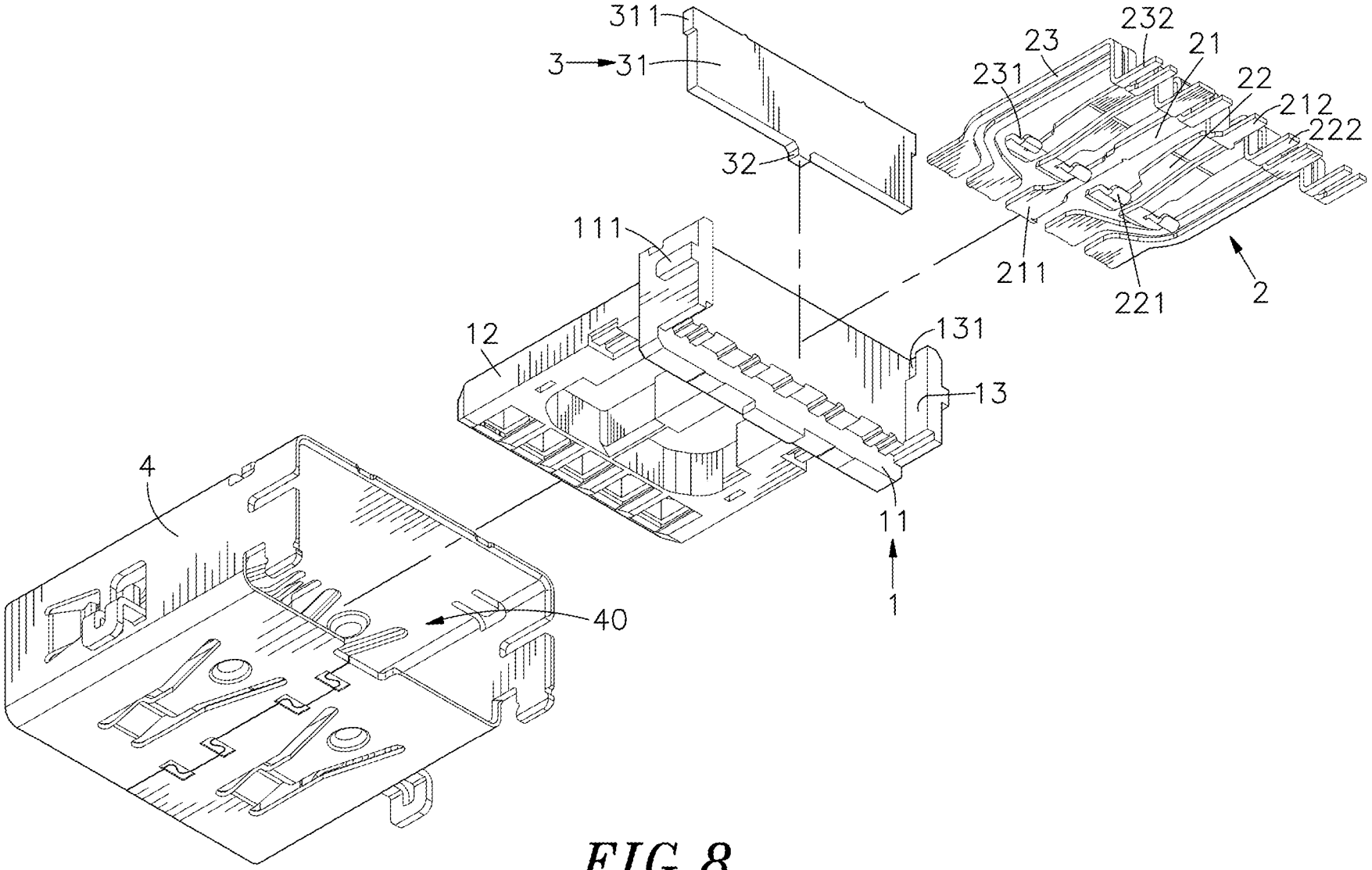
FIG. 8 is another exploded view of the electrical connector grounding structure of the second embodiment of the present invention when viewed from another angle.
Figure 9:
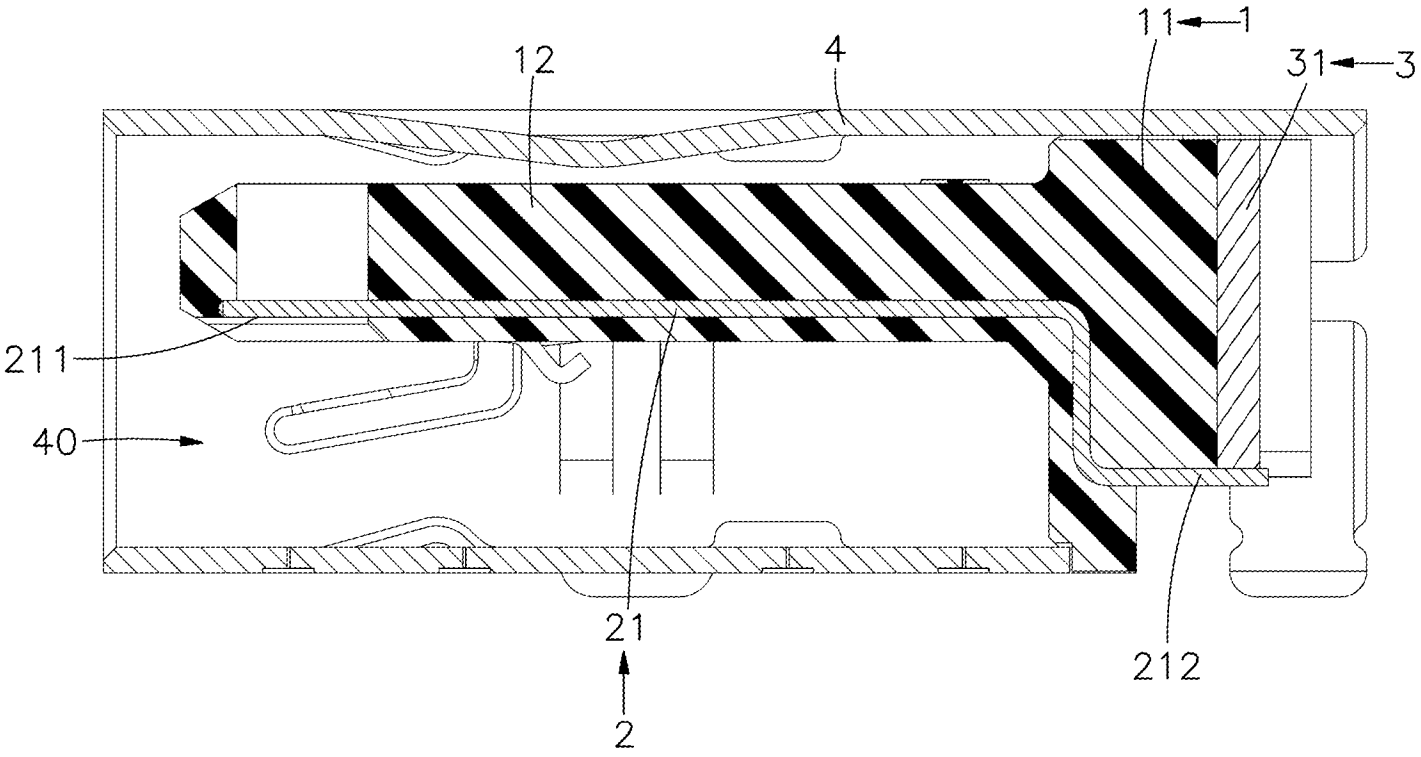
FIG. 9 is a sectional side view of the electrical connector grounding structure of the second embodiment of the present invention.
Figure 10:
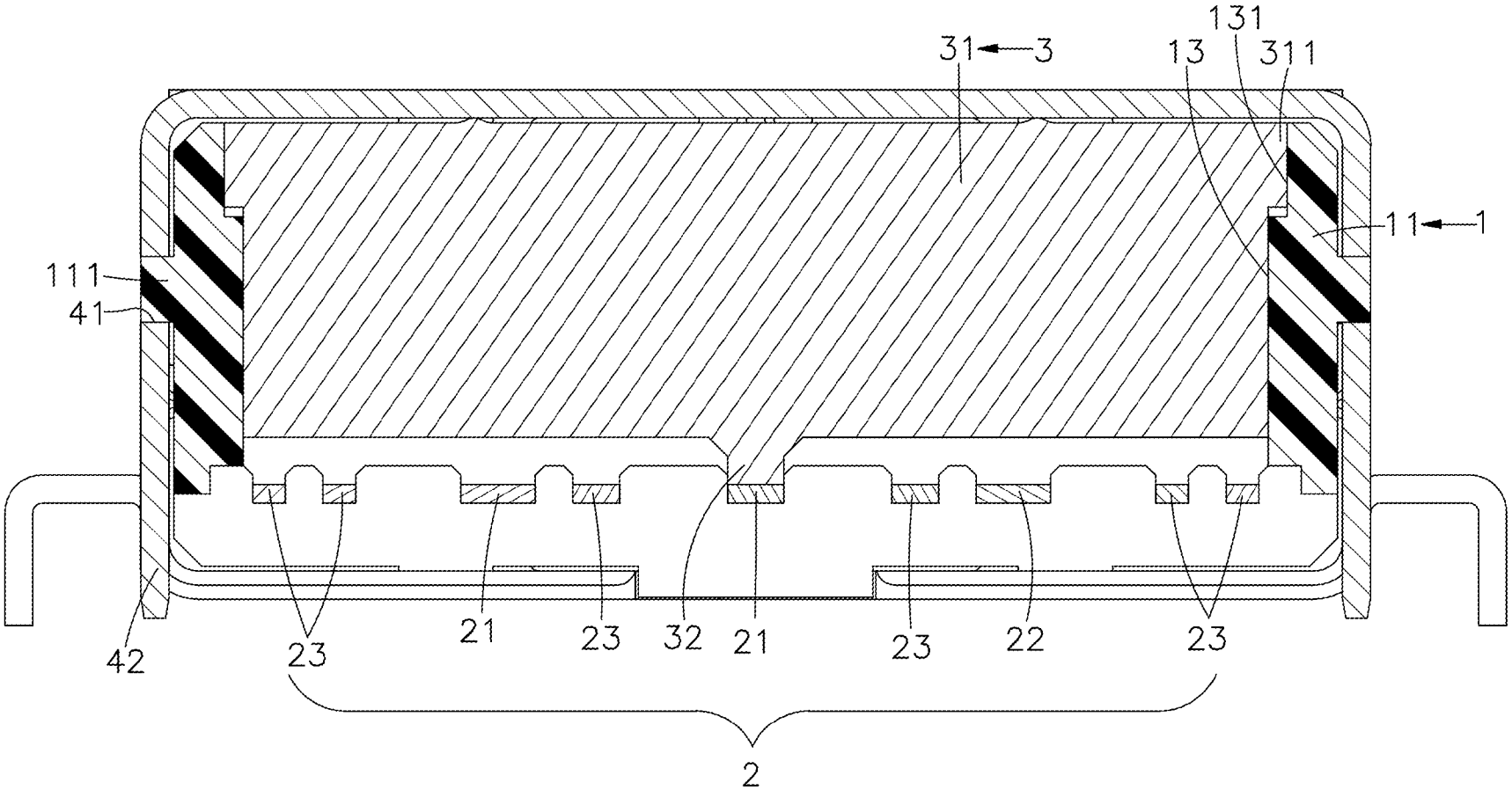
FIG. 10 is another sectional side view of the electrical connector grounding structure of the second embodiment of the present invention.

Referring to FIGS. 1-5, an oblique top elevational view of an electrical connector grounding structure in accordance with a first embodiment of the present invention, an exploded view of the electrical connector grounding structure of the first embodiment of the present invention, another exploded view of the electrical connector grounding structure of the first embodiment of the present invention when viewed from another angle, a sectional side view of the electrical connector grounding structure of the first embodiment of the present invention and another sectional side view of the electrical connector grounding structure of the first embodiment of the present invention are shown. As illustrated, the electrical connector grounding structure comprises an electrically insulative housing 1, a conducting terminal sets 2, a conducting member 3 and a shielding shell 4.

The electrically insulative housing 1 comprises a base 11, two retaining blocks 111 respectively located on two opposite lateral sidewalls of the base 11, a tongue plate 12 forwardly extended from a front side of the base 11, an accommodation hole 13 located on a top surface of the base 11 in the middle adjacent to the tongue plate 12, and two locating grooves 131 located on the top surface of the base 11 at two opposite lateral sides of the accommodation hole 13.

The conducting terminal sets 2 comprises at least one grounding terminal 21, at least one power terminal 22 and a plurality of signal terminals 23. Each grounding terminal 21 has a first mating contact portion 211 extended from one end thereof, and a first bonding portion 212 extended from an opposite end thereof. Each power terminal 22 has a second mating contact portion 221 extended from one end thereof, and a second bonding portion 222 extended from an opposite end thereof. Each signal terminal 23 has a third mating contact portion 231 at one end thereof, and a third bonding portion 232 at an opposite end thereof.

The conducting member 3 is a T-shaped member, having a first contact portion 31 transversely disposed at the top and a second contact portion 32 vertically downwardly extended from a middle part of a bottom surface of the first contact portion 31.

The shielding shell 4 has a docking space 40 defined therein, two engagement slots 41 respectively located on two opposite lateral sides thereof, and at least one grounding leg 42 downwardly extended from a bottom edge of each of the two opposite lateral sides.

The base 11 and the tongue plate 12 of the electrically insulative housing 1 are preferably separately made. However, in practical applications, the base 11 and the tongue plate 12 can be made integrally in one piece. However, there are many ways of constructing the base 11 and the tongue plate 12, and they can be changed and implemented according to practical applications, and the detailed composition is not the main point of the present invention, so we will not repeat them here.

The conducting terminal sets 2 conforms to the USB3.0 specification, and from left to right are differential signal terminal (SSTX+), differential signal terminal 23 (SSTX−), power terminal 22 (V BUS), differential signal terminal 23 (D−), grounding terminal 21 (GND_DRAIN), differential signal terminal 23 (D+), grounding terminal 21 (GND), differential signal terminal 23 (SSRX+) and differential signal terminal 23 (SSRX−).

The conducting member 3 may be polyacetylene polyaniline, polypyrrole, polythiophene, poly(p-styrene) or the conductive plastic of the aforementioned derivatives.

When the components of the present invention are assembled, first insert the plurality of grounding terminals 21, at least one power terminal 22 and plurality of signal terminals 23 of the conducting terminal sets 2 through the base 11 of the electrically insulative housing 1 and the tongue plate 12 to let the first mating contact portions 211 of the grounding terminals 21, the second mating contact portion 221 of each of the at least one power terminal 22 and the third mating contact portions 231 of the signal terminals 23 be exposed out of the surface of the tongue plate 12 and the first bonding portions 212 of the grounding terminals 21, the second bonding portion 222 of each of the at least one power terminal 22 and the third bonding portions 232 of the signal terminals 23 be suspended outside the base 11, and then mount the conducting member 3 in the accommodation hole 13 of the electrically insulative housing 1 to position the first contact portion 31 of the conducting member 3 in the locating grooves 131. At this time, the second contact portion 32 of the conducting member 3 is disposed in contact with the surface of the at least one grounding terminal 21 in front of the first bonding portion 212. Thereafter, place the electrically insulative housing 1 in the docking space 40 of the shielding shell 4 to engage the two retaining blocks 111 at the two opposite lateral sides of the base 11 into the respective engagement slots 41 of the shielding shell 4 and to keep the first contact portion 31 of the conducting member 3 in contact with an inner wall surface of the shielding shell 4 around the docking space 40. Thus, the grounding terminals 21 of the conducting terminal sets 2 are electrically conducted to the shielding shell 4 through the conducting member 3 and the assembly process of the present invention is completed.

The aforementioned conducting terminal sets 2 and conducting member 3 are preferably embedded in the electrically insulative housing 1 by means of insert molding. However, in practical applications, this is not a limitation. The conducting terminal sets 2 and conducting member 3 can also be assembled with the electrically insulative housing 1 according to actual needs or structural design.

In addition, the USB connector of the above assembly can be a universal serial bus female socket or a male plug type.

When the present invention is in actual use, first insert the base 11 of the electrically insulative housing 1 downwardly in the circuit board (not shown) to position the first bonding portions 212 of the grounding terminals 21, the second bonding portion 222 of each of the at least one power terminal 22 and the third bonding portions 232 of the signal terminals 23 of the conducting terminal sets 2 on the respective contacts of the circuit board, and then use surface mount technology (SMT) or through hole technology to bond the first bonding portions 212, the second bonding portions 222 and the third bonding portions 232 to the respective contacts of the circuit board electrically, and then bond the grounding legs 42 of the shielding shell 4 to the circuit board, and thus, the present invention is firmly fixed on the circuit board.

When the electrical connector grounding structure of the first embodiment of the present invention is electrically connected to an external mating USB connector (not shown) for the transmission of data and power, the at least one grounding terminal 21 of the conducting terminal sets 2, the conducting member 3 and the shielding shell 4 form a common ground loop to guide electromagnetic interferences (EMI) and noises generated around the electrical connector to the circuit board for grounding release. It can effectively suppress or filter electromagnetic interferences (EMI) and crosstalk interferences generated during signal transmission, thereby making the overall signal transmission quality more stable and reliable and achieving the effect of improving the overall signal transmission stability.

Referring to FIGS. 6-10, an oblique top elevational view of an electrical connector grounding structure in accordance with a second embodiment of the present invention, an exploded view of the electrical connector grounding structure of the second embodiment of the present invention, another exploded view of the electrical connector grounding structure of the second embodiment of the present invention when viewed from another angle, a sectional side view of the electrical connector grounding structure of the second embodiment of the present invention and another sectional side view of the electrical connector grounding structure of the second embodiment of the present invention are shown. As illustrated, this second embodiment is substantially similar to the aforesaid first embodiment with the exceptions that the accommodation hole 13 of the electrically insulative housing 1 is formed in the rear side of the base 11; the area of the first contact portion 31 of the conducting member 3 is larger than that of the aforesaid first embodiment; the conducting member 3 further comprises two locating blocks 311 respectively protruded from two opposite lateral sides of the first contact portion 31 in flush with the topmost edge of the first contact portion 31 and respectively positioned in the locating grooves 131 at the two opposite lateral sides of the accommodation hole 13. The design of the relatively larger area of first contact portion 31 increases the conduction area to increase the speed of electromagnetic waves and high-frequency interference conduction to ground, so that is can effectively suppress or filter electromagnetic interferences (EMI) and crosstalk interferences generated during signal transmission, thereby making the overall signal transmission quality more stable and reliable and achieving the effect of improving the overall signal transmission stability.

Figure 11:
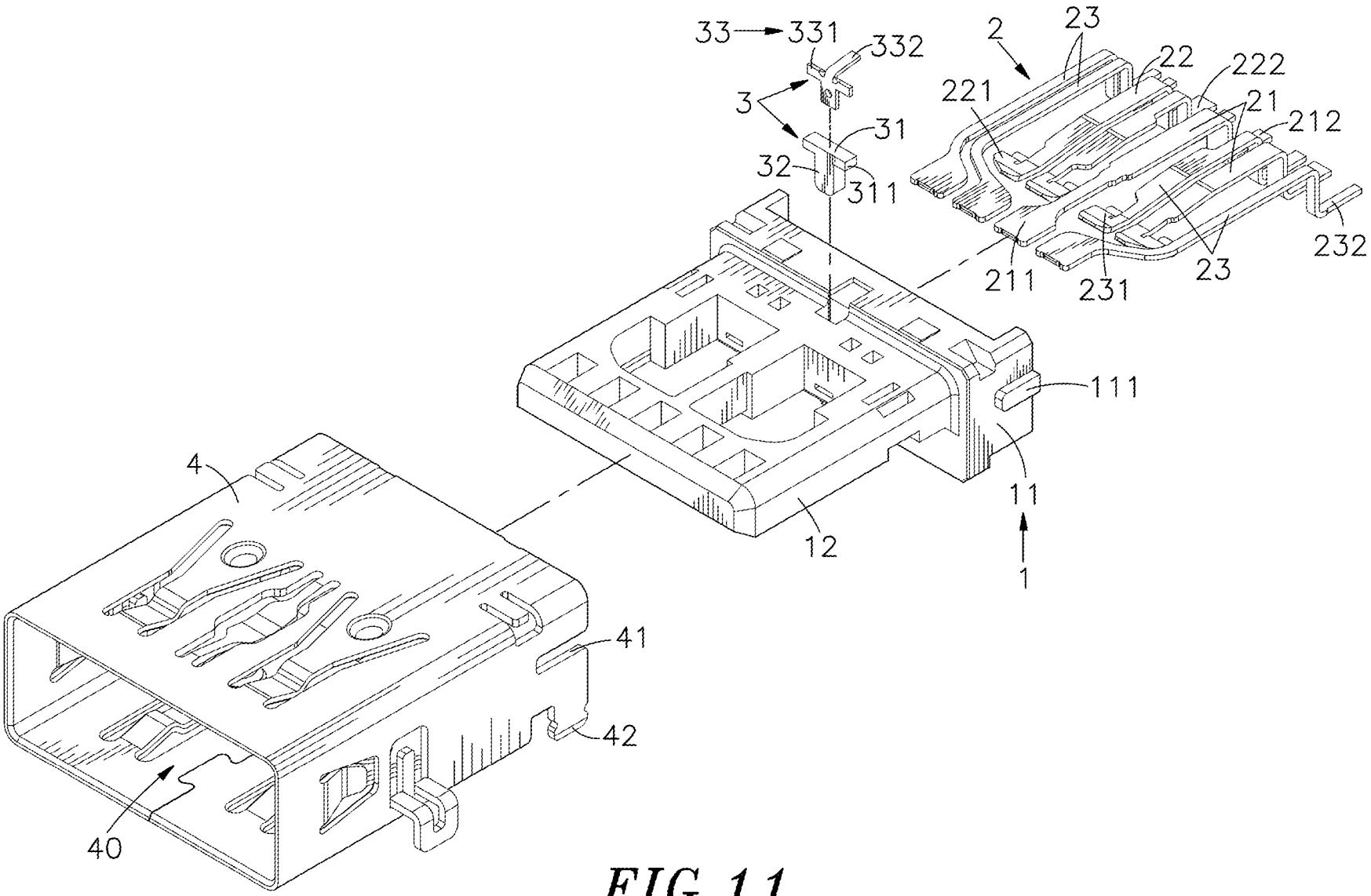
FIG. 11 is an exploded view of the electrical connector grounding structure in accordance with a third embodiment of the present invention.
Figure 12:
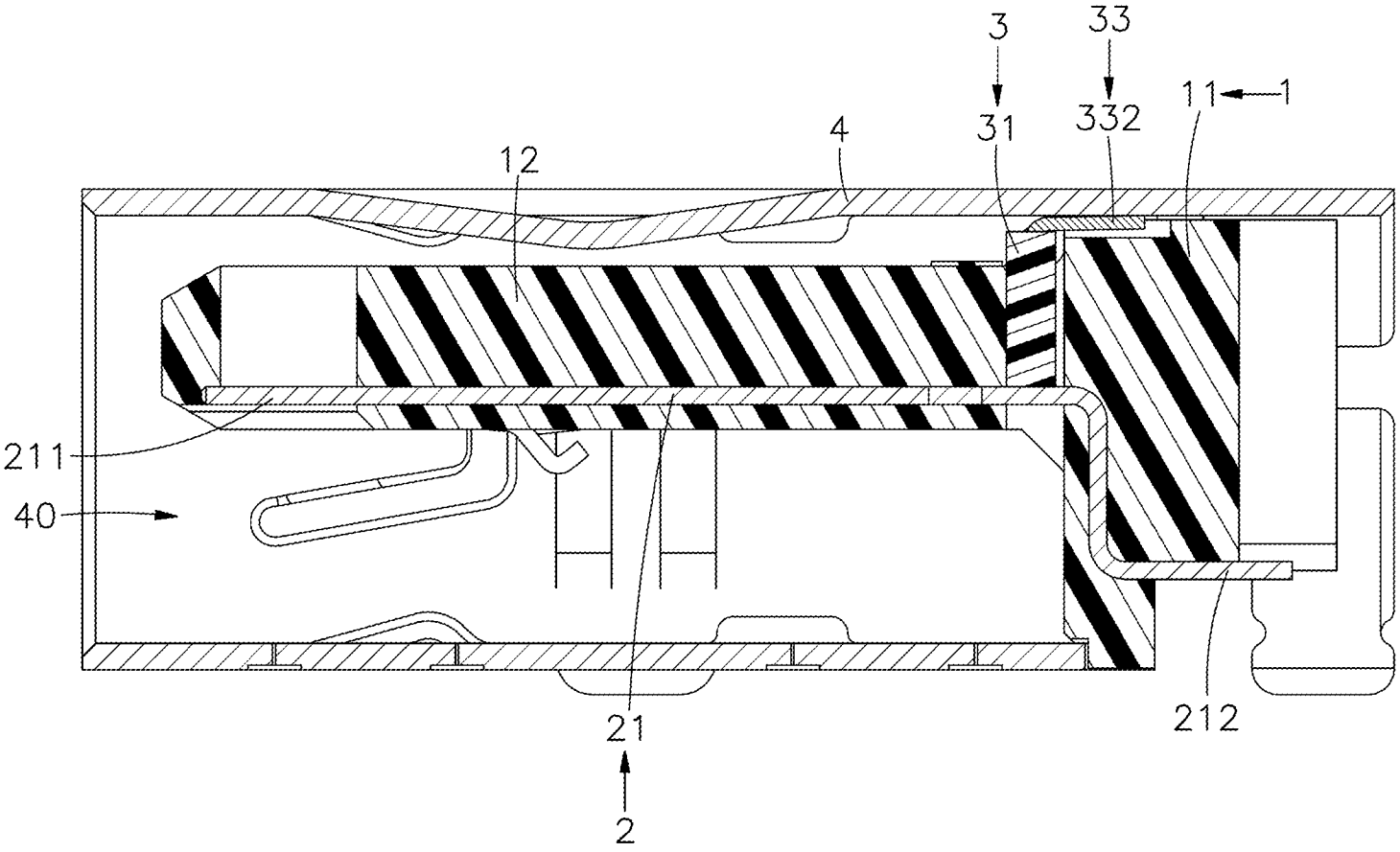
FIG. 12 is a sectional side view of the electrical connector grounding structure of the third embodiment of the present invention.

Referring to FIGS. 11 and 12, an exploded view of the electrical connector grounding structure in accordance with a third embodiment of the present invention and a sectional side view of the electrical connector grounding structure of the third embodiment of the present invention are shown. According to this third embodiment, the conducting member 3 has a conducting plate embedded therein using insert molding technology. The conducting plate 33 has a base portion 331 embedded in the conducting member 3, and a first spring leaf 332 extended from a top side of the base portion 331 and disposed in contact with an inner surface of the shielding shell 4 in the docking space 40 electrically.

Figure 13:
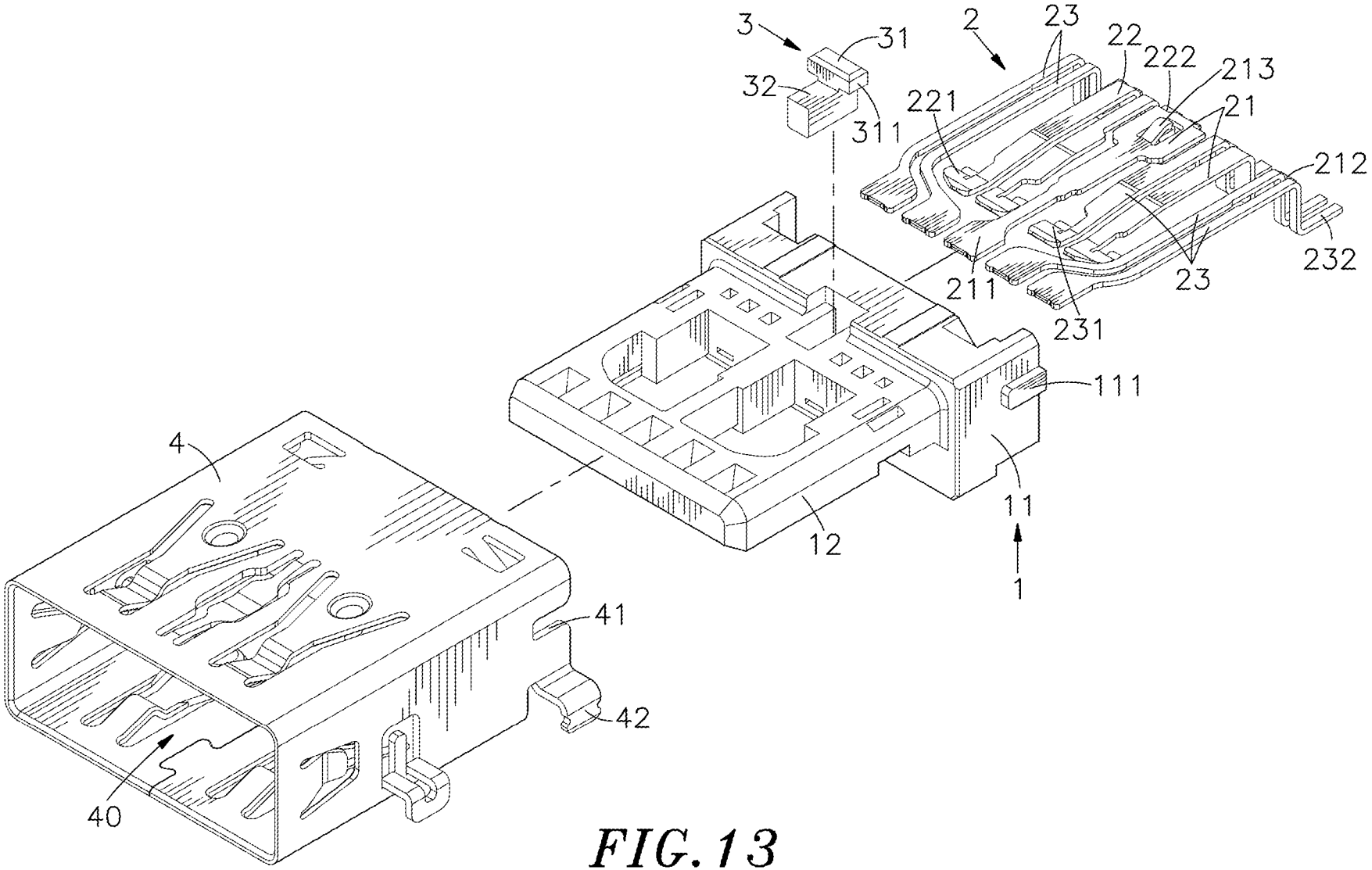
FIG. 13 is an exploded view of the electrical connector grounding structure in accordance with a fourth embodiment of the present invention.
Figure 14:
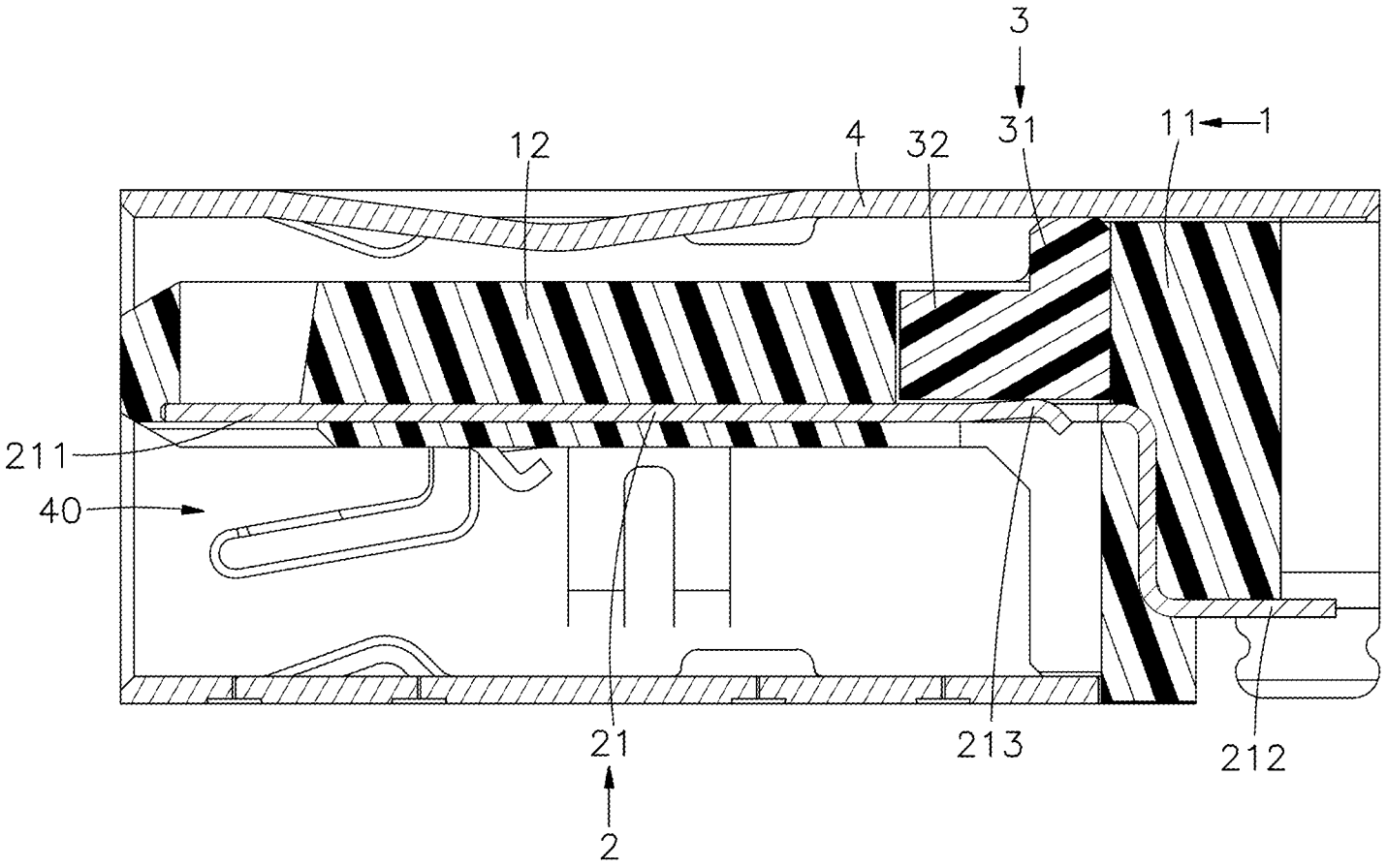
FIG. 14 is a sectional side view of the electrical connector grounding structure of the fourth embodiment of the present invention.

Referring to FIGS. 13 and 14, an exploded view of the electrical connector grounding structure in accordance with a fourth embodiment of the present invention and a sectional side view of the electrical connector grounding structure of the fourth embodiment of the present invention are shown. According to this fourth embodiment, each grounding terminal 21 of the conducting terminal sets 2 comprises a second spring leaf 213 extended from the surface thereof and disposed in contact with the second contact portion 32 of the conducting member 3 electrically.

Although particular embodiments of the invention have been described in detail for purposes of illustration, various modifications and enhancements may be made without departing from the spirit and scope of the invention. Accordingly, the invention is not to be limited except as by the appended claims.

What the invention claimed is:

1. An electrical connector grounding structure comprising an electrically insulative housing, a conducting terminal sets, a conducting member and a shielding shell, wherein:

said electrically insulative housing comprises a base, an accommodation hole located on said base and a tongue plate extended from a front side of said base;

said conducting terminal sets comprises at least one grounding terminal, at least one power terminal and a plurality of signal terminals respectively positioned in said electrically insulative housing;

said conducting member is positioned in said accommodation hole of said electrically insulative housing, comprising a first contact portion and a second contact portion extended from a bottom side of said first contact portion and disposed in contact with said at least one grounding terminal;

said shielding shell comprises a docking space that accommodates said electrically insulative housing to keep said shielding shell in electrical contact with said first contact portion of said conducting member;

wherein said conducting member is provided with a conducting plate, said conducting plate comprising a base portion positioned in said conducting member and a first spring leaf extended from a top side of said base portion and disposed in contact with an inner surface of said shielding shell in said docking space.

2. The electrical connector grounding structure as claimed in claim 1, wherein said electrically insulative housing further comprises two retaining blocks respectively located on two opposite lateral sides of said base; said shielding shell further comprises two engagement slots respectively located at two opposite lateral sides relative to said docking space and respectively engaged with said retaining blocks of said electrically insulative housing.

3. The electrical connector grounding structure as claimed in claim 1, wherein said electrically insulative housing further comprises two locating grooves located on said base at two opposite lateral sides of said accommodation hole for the positioning of said first contact portion of said conducting member.

4. The electrical connector grounding structure as claimed in claim 3, wherein said conducting member further comprises two locating blocks respectively protruded from two opposite lateral sides of said first contact portion and respectively positioned in said locating grooves at the two opposite lateral sides of said accommodation hole.

5. The electrical connector grounding structure as claimed in claim 1, wherein each said grounding terminal of said conducting terminal set comprises a first mating contact portion located at one end thereof and exposed outside said tongue plate, and a first bonding portion located at an opposite end thereof and extending out of said base; each said power terminal comprises a second mating contact portion located at one end thereof and exposed outside said tongue plate, and a second bonding portion located at an opposite end thereof and extending out of said base; each said signal terminal comprises a third mating contact portion located at one end thereof and exposed outside said tongue plate, and a third bonding portion located at an opposite end thereof and extending out of said base.

6. The electrical connector grounding structure as claimed in claim 5, wherein said accommodation hole of said electrically insulative housing is located in the middle of said base; said conducting member positioning in said accommodation hole is positioned at a front side relative to said first bonding portion.

7. The electrical connector grounding structure as claimed in claim 1, wherein each said grounding terminal of said conducting terminal set comprises a second spring leaf extended from the surface thereof and disposed in contact with said second contact portion of said conducting member.

8. The electrical connector grounding structure as claimed in claim 1, wherein said shielding shell further comprises at least one grounding leg extended from a bottom edge of each of two opposite lateral sides thereof.

* * * * *